US005111975A

United States Patent [19]

Roberts

[11] Patent Number: 5,111,975

[45] Date of Patent: May 12, 1992

[54] DECANTER HAVING SHOCK ABSORBER

[75] Inventor: Melvin F. Roberts, Niles, Ill.

[73] Assignee: Specialty Equipment Companies, Inc., Chicago, Ill.

[21] Appl. No.: 756,973

[22] Filed: Sep. 9, 1991

Related U.S. Application Data

[63] Continuation-in-part of Ser. No. 662,790, Mar. 1, 1991.

[51] Int. Cl.[5] ..... A47G 19/14

[52] U.S. Cl. ..... 222/475.1; 215/1 R; 215/100 R; 220/732

[58] Field of Search ..... 222/465.1, 475, 475.1; 215/12.2, 101, 1 R, 100 R, 100 A; 220/85 K, DIG. 21, 632

[56] References Cited

U.S. PATENT DOCUMENTS

| | | | |
|---|---|---|---|
| 845,777 | 3/1907 | Grossman | 220/632 X |
| 1,959,262 | 5/1934 | Colabrese | 220/632 |
| 2,565,793 | 8/1951 | Weismantel | 220/632 X |
| 2,774,502 | 12/1956 | Novak | 220/85 K X |
| 3,688,936 | 9/1972 | Killigrew, Jr. | 220/85 K X |
| 3,717,288 | 2/1973 | Schlegel | 222/465.1 |
| 3,972,435 | 8/1976 | Sasaki et al. | 215/12.2 |
| 4,094,449 | 6/1978 | Schlegel et al. | 222/475 |
| 4,140,252 | 2/1979 | Karlen | 222/475.1 |

*Primary Examiner*—Kevin P. Shaver
*Attorney, Agent, or Firm*—Myers & Associates, Ltd.

[57] ABSTRACT

A container for serving hot beverages and soup having a glass bowl and a shock absorbing band exteriorly arranged on said bowl. The band may be formed from a plastic or rubber material and reduce breakage of the decanter. The band includes tapered upper and lower edge portions and an internal cavity for forming air cushion for enhanced protection against impact.

8 Claims, 2 Drawing Sheets

FIG. 1
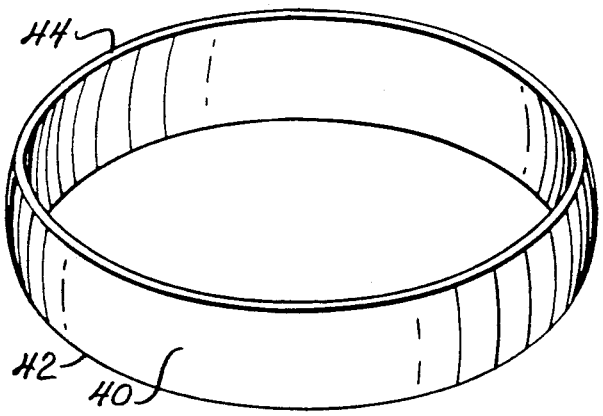
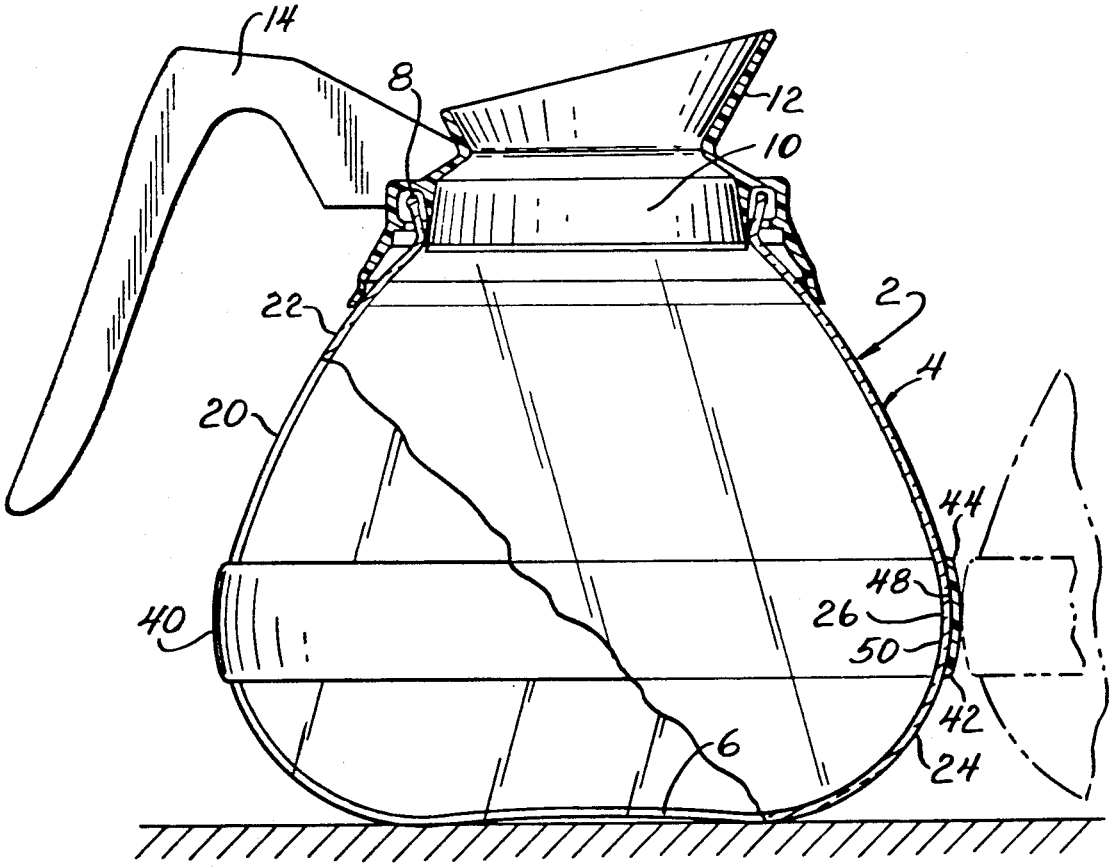
FIG. 2

DECANTER HAVING SHOCK ABSORBER

This is a continuation-in-part of my copending application entitled Decanter Having Shock Absorber, Ser. No. 662,790 pending filed Mar. 1, 1991.

BACKGROUND OF THE INVENTION

1. Field of the Invention

This invention relates in general to liquid containers and more particularly, to a container, decanter, or pot for carrying hot liquids, such as coffee and the like, and having an exterior shock absorber ring or band.

2. Description of the Prior Art

As is well known, coffee, tea and other hot beverages or soups are commonly served in glass containers, decanters, or pots. Such liquids often are elevated to boiling temperatures capable of scalding the skin of an individual and inflicting serious injury, some involving third degree burns. One cause of burns from hot beverages, such as coffee, has frequently resulted from the service techniques of servers in restaurants and the like. For example, a waiter or waitress may have to serve either caffeinated or decaffeinated coffee to particular customers at a table. For convenience, the servers will simultaneously carry two separate containers or decanters of hot caffeinated and decaffeinated coffee to a table for pouring. On occasion the waitresses or waiters carry the two separate glass pots in one hand and the containers bump into each other.

In certain cases, the two decanters hit each other with a force sufficient to break at least one of the decanters and spill dangerously hot coffee on a customer who sustains injury. In other situations, the contact creates a crack to form a weakened stress area. This condition of the cracked container is often overlooked by the server, and the decanter eventually shatters to potentially cause serious burns to individuals.

For many reasons, glass decanters are the preferred containers for serving hot coffee and the like. None of the known containers formed from glass or other equally fragile material have effectively solved the serious problem of breakage of glass service containers as frequented in use in the manner previously discussed.

SUMMARY OF THE INVENTION

It is an objective of the present invention to provide an improved container or decanter for serving hot liquids, such as coffee, tea, soup, and the like, that is capable of withstanding shocks and resisting breakage. The container of the invention includes means forming a shock absorber positioned on the glass decanter in an area adjacent its maximum diameter. The shock absorbing means may be formed in the shape of external band or ring fabricated from a resilient material, such as, for example, polypropylene, plastic, rubber, and the like. The presence of the shock absorbing band of the invention not only minimizes damage from impact with a second container having the shock absorber of the invention, but also can minimize damage from impact with the glass of other decanters not having such a shock absorber or from impact against the side of a table and the like. By reducing the shock between bumping decanters or against other objects, the possibility of injury to individuals from scalding liquids can be reduced for the benefit of restaurants and similar applications. The shock absorbing ring includes a shock absorbing cavity creating an air cushion at areas of maximum impact for further protection and effectiveness.

BRIEF DESCRIPTION OF THE DRAWINGS

FIG. 1 is front elevational view, with parts in section, of a container having a first embodiment of the shock absorber band of the invention;

FIG. 2 is front perspective view of the shock absorber band of the invention of FIG. 1;

DESCRIPTION OF THE PREFERRED EMBODIMENTS

Figure 3:
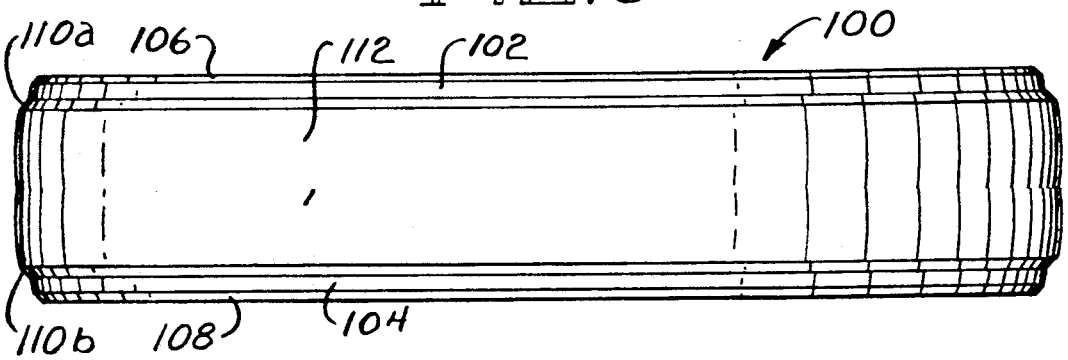
FIG. 3 is a side elevational view of a second embodiment of the shock absorber of the invention.

Referring now to FIG. 1, there is illustrated a container or decanter for serving hot liquids, such as coffee and the like, and generally designated by reference numeral 2. The container 2 includes a symmetrically formed glass bowl 4 capable of retaining liquids at boiling conditions. The glass bowl 4 includes a flat bottom 6 and an upper annular glass rim 8 defining a top dispensing opening 10. A conventional plastic pouring lip structure 12 having an integral handle 14 is fitted in a known manner on rim 8 for proper dispensing of the hot liquid. As seen in FIG. 1, the bowl 4 further includes a continuous circumferentially arranged wall 20 forming the liquid receiving cavity of decanter 2. The upper portion 22 of wall 20 increases in diameter in a downward direction from rim 8 with a small outward bowed curved configuration as seen in the cross sectional view of FIG. 1.

The lower portion 24 of wall 20 forms an outward belly-like shape 26 defined by a curvature of the wall 24 having a constant radius for an extent generally from the bottom of upper wall portion 22 to approximately the flat bottom 6. The circular cross section of lower portion 24 establishes a maximum circumferentially extending diameter of bowl 4 at area 32 as shown in FIG. 1.

In FIGS. 1 and 2, there is shown a first embodiment of the snap-on band or ring 40 of the invention in the form of a continuous ring and positioned circumferentially about bowl 4 in generally symmetrical relationship with the line coinciding with the maximum diameter of bowl 4. The band 40 is preferably formed from a suitable elastomeric shock absorbing material, such as, for example, polypropylene, plastic, rubber, and the like. The length of band 40 is selected to interfit with bowl 4 with sufficient frictional contact to maintain the band 40 in position during use.

The upper and lower edge portions 42 and 44 of band 40 are sloped or tapered, such as at a 45 degree angle or other amount, with respect to the horizontal axis. The sloped edges 42 and 44 insure contact between the band 40 and the outer convex shape of bowl 4 at the edge portions of the band 40 to prevent separation from the bowl 40 and prevent foreign material, such as grease, coffee and the like, from seeping between the band 40 and bowl 4. The thickness of band 40 is selected to be of a sufficient amount to minimize damage to the bowl 4 dependent on expected impact conditions and the shock absorbing characteristics of the material of band 40.

As an aid to insure proper retention of the band 40 on the curved outer shape of bowl 4, a portion of the interior surface 48 of the band 4 can be cut away at cavity section 50 to create a suction effect and further enhance superior contact along the curved interface. The cavity section between the exterior of the bowl 4 and the cut away portion of the surface 48 also creates an air cushioning effect for better protection of the fragile glass bowl 4. The vertical height of band 40 is constant along its circular extent and is selected to maximize protection of the decanter 4 under expected conditions. The band 40 provides shock absorbing protection when decanter 4 impacts the band 40 of a second decanter being carried by a server or any other object. Since individuals also tend to carry decanters in one hand in an angular relationship to each other, the band 40 of the invention is capable of providing protection by causing the glass of one decanter to hit the band 40 of the adjacent decanter to also reduce the possibility of damage to the containers. Although the band 40 has been described as in effect being stretched for retention on the bowl 4, it is within the scope of the invention to retain the band 40 to the decanter 2 by an adhesive and the like.

Figure 4:
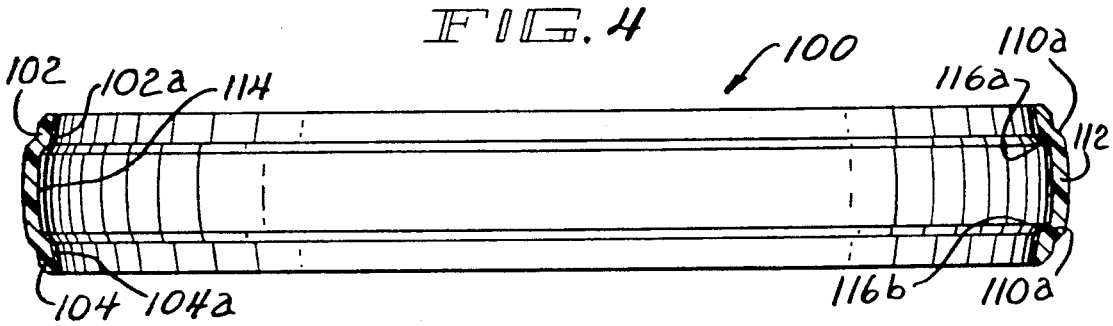
FIG. 4 is a sectional side elevational view taken through the vertical center line of the shock absorber of FIG. 3.
Figure 5:
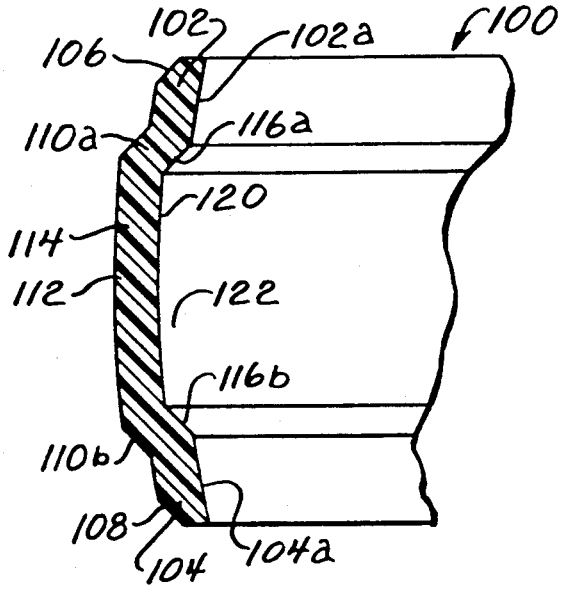
FIG. 5 is an enlarged partial sectional view of FIG. 4.

Referring to FIGS. 3 to 5, there is illustrated a second embodiment of the shock absorber ring or band of the invention, generally designated by reference numeral 100. The band 100 is formed as an continuous ring from a suitable polypropylene, plastic, rubber and the like. It is advantageous for the material forming band 100 be capable of absorbing shocks, but also to be heat resistance for withstanding the elevated temperatures of the heated coffee. The band 100 is intended to be in arranged surrounding frictional relationship on the glass bowl (not shown), in the manner as described with reference to the embodiment shown in FIG. 1 and 2.

The shock absorber band 100 is provided with upper and lower edge portions 102 and 104 that project inwardly in an unstressed configuration when not mounted on the bowl for resiliently gripping the glass bowl (not shown) that biases the edge portions outwardly against interior surfaces 102*a* and 104*a* (FIGS. 3 and 4) and prevents seepage of liquid and other material between the band 100 and the bowl. The upper and lower edges 106, 108 of the upper and lower edge portions 102, 104 respectively are integrally formed with outwardly projecting wall sections 110*a, b* that are connected to a central bulging wall portion 112. The central wall portion 112 acts as the primary shock absorbing area of the band 100 and includes a gently curved, outer impact surface 114. The interior surfaces 116*a, b* of the connecting wall portion 110 and the internal surface 120 of central impact portion 112 create an air space or cavity 122 between the glass bowl and the central portion of the band. The resilient gripping of the upper and lower edge portions 102 and 104 against the bowl generally seals cavity 122 so to provide an effective air cushion against impact.

What is claimed is:

1. A container for serving liquids comprising a bowl forming a liquid receiving cavity, said bowl having a bottom and a continuous side wall defining the sides of the cavity, shock absorber means exteriorly positioned on said side wall for preventing damage to said side wall from impact, said shock absorber means being a band positioned around the bowl, said band includes an interior surface in contact with said side wall at upper and lower edge portions of said band, said interior surface forming an interior cavity between said bowl and said band, and said interior cavity being disposed between said upper and lower edge portions.

2. The container according to claim 1 wherein said side wall is defined by a circumferentially extending curved wall, said curved wall having an area of maximum exterior diameter, said shock absorber means being disposed about a portion of said curved wall adjacent said area of maximum exterior diameter.

3. The container according to claim 1 wherein said band is fabricated from a elastomeric material.

4. The container according to claim 1 wherein said upper and lower edge portions are tapered.

5. The container according to claim 1 wherein said side wall has a curved configuration between upper and lower edges of said container.

6. The container according to claim 1 wherein said upper and lower edges of said band are projected inwardly toward upper and lower edges of said container in an unstressed, not-mounted configuration.

7. The container according to claim 1 wherein said interior cavity is formed by an intermediate portion of said band bulging outward from said upper and lower edge portions.

8. The container according to claim 7 wherein said intermediate portion is integrally connected to said upper and lower edges by a respective pair of sloped sections.

* * * * *